US005566405A

United States Patent [19]

Masley

[11] Patent Number: 5,566,405

[45] Date of Patent: Oct. 22, 1996

[54] METHOD OF MANUFACTURING A HAND COVERING

[75] Inventor: Francis J. Masley, Wilmington, Del.

[73] Assignee: W. L. Gore & Associates, Inc., Newark, Del.

[21] Appl. No.: 412,824

[22] Filed: Mar. 29, 1995

[51] Int. Cl.[6] ..... A41D 19/00

[52] U.S. Cl. ..... 2/169; 2/161.6; 2/159

[58] Field of Search ..... 2/169, 159, 161.6, 2/160, 161.1, 161.7, 901; 223/78, 79

[56] References Cited

U.S. PATENT DOCUMENTS

| | | | |
|---|---|---|---|
| 242,070 | 5/1881 | Spooner | 223/78 |
| 1,885,446 | 11/1932 | Johanson | 2/159 |
| 2,970,317 | 2/1961 | Winson | 2/169 |
| 3,175,226 | 3/1965 | Weinberg | 2/169 |
| 3,822,417 | 7/1974 | Lars-jos | 2/169 |
| 4,430,759 | 2/1984 | Jackrel | 2/159 |
| 4,476,588 | 10/1984 | Long | 2/159 |
| 4,534,066 | 8/1985 | Hansson | 2/163 |
| 4,583,248 | 4/1986 | Edwards et al. | 2/164 |
| 4,587,672 | 5/1986 | Madnick et al. | 2/159 |
| 4,594,736 | 6/1986 | Connelly | 2/163 |
| 4,654,896 | 4/1987 | Rinehart | 2/163 |
| 4,831,667 | 5/1989 | Town | 2/163 |
| 4,884,300 | 12/1989 | Vistins | 2/169 |
| 5,036,551 | 8/1991 | Dailey et al. | 2/167 |
| 5,167,038 | 12/1992 | Rinehart | 2/164 |
| 5,391,426 | 2/1995 | Wu | 428/246 |

*Primary Examiner*—Amy B. Vanatta
*Attorney, Agent, or Firm*—Victor M. Genco, Jr.

[57] ABSTRACT

A method for manufacturing an improved hand covering is provided which is defined by mating first and second hand shaped portions seamed one to each other to form a complete hand covering. The hand covering defines at least one finger stall, a thumb stall, a palm portion, a dorsal portion, and at least one finger crotch. At least one vertical fold is permanently defined in the hand covering. The at least one vertical fold is oriented substantially parallel to the at least one finger stall. The at least one vertical fold reduces an original palm circumferential dimension of the hand covering in an amount from about 10% to about 50%.

4 Claims, 7 Drawing Sheets

METHOD OF MANUFACTURING A HAND COVERING

FIELD OF THE INVENTION

This invention generally relates to hand coverings. More particularly, the present invention relates to a method of manufacturing a hand covering, which is well fitting and which may be employed individually, (i.e. as a stand alone hand covering) or in combination with a glove shell as either a liner or insert.

BACKGROUND OF THE INVENTION

Historically, the making of hand coverings, such as gloves, glove liners or glove inserts, has required the use of skilled labor to manufacture and seam together various complicated uneven panels of patterns to provide a comfortable fit. Presently, most glove patterns, and patterns used to make glove liners and glove inserts, do not lend themselves well, if at all, to automatic seaming methods. Additionally, those patterns which can easily be automatically seamed do not provide a comfortable fit in all of the portions of the glove, liner or insert. Among the various glove patterns presently in use are the Clute Cut Pattern, the Gunn Cut Pattern, the Fourchette or Montpelier Pattern and the Flat Pattern.

The Clute Cut Pattern provides roominess in the finger for good fit by wrapping material around the back or dorsal part of the finger. The front, or palmar panel of the finger, is cut to a width that approximates the width of the finger plus desired clearances. The back, or dorsal panel of the finger, must be cut to a width that approximates the finger width, as well as two thicknesses of the finger plus desired clearances. The discrepancy in the widths of the dorsal finger panel and the palmar finger panel requires that the edges of the dorsal panel be carefully placed together with the edges of the palmar finger panel when it is sewn to the palmar finger panel. This alignment of the edges precludes automatic seaming of the finger panels and necessitates the use of skilled labor in assembling the hand covering, which of course, increases the attendant manufacturing cost of such a hand covering.

The Gunn Cut Pattern provides roominess in the finger for good fit by wrapping material around the front of the finger, rather than the back of the finger, as is done in the Clute Cut Pattern. The Gunn Cut Pattern suffers from similar problems in assembly as the Clute Cut Pattern. Similarly, the attendant manufacturing costs of a hand covering made from such a pattern are increased.

In the Fourchette or Montpelier Pattern, roominess in the finger for good fit is provided by material being equally divided between the palm, back and sides of the fingers. This pattern has many panels which must be seamed together to form the hand covering. As with the Clute Cut Pattern and the Gunn Pattern, a Fourchette or Montpelier Pattern hand covering is costly to produce and may not be manufactured by seaming in-the-flat.

The Flat Pattern incorporates palmar and dorsal panels which are the same size. Flat Pattern hand coverings are seamed together "in-the-flat". The front and back panels of the Flat Pattern are each single whole pieces and are generally mirror images of one another. The disadvantage of this Flat Pattern is that it compromises the fit of the hand covering. The quality of a fit achievable by the Flat Pattern is limited by the fact that each half finger portion must have a width at its base and throughout its length that approximates half of the circumference of the finger, plus desired clearance and seam widths, in order to properly fit the finger. Thus, the sum of the widths of each panel at the base of each finger approximates half of the sum of the circumference of each finger, plus desired clearances and eight seam widths, whereas the width of material required to cover the palm of the hand at the base of the fingers is only approximately half of the circumference of the palm, plus desired clearances and two seam widths. Therefore, if the Flat Pattern is used, the sum of the widths of each panel at the base of the fingers includes much more material than is required to enclose the palm and back of the hand. This additional material gathers in the palm or back of the hand covering.

From the foregoing, it should be readily apparent that, although a Flat Pattern hand covering may be easily seamed in-the-flat, (i.e. the Flat Pattern allows for automatic seaming, thereby reducing manufacturing costs) the fit of a hand covering made from this pattern must be compromised by either having the palm fit too loosely, if the fingers fit properly, or by having the fingers fit too tightly, if the palm fits properly.

In any of the hand covering constructions described above, it is sometimes desirable to provide a waterproof insert member or liner to protect the wearer's hand against moisture. Also, it may be desirable to provide a liner which is suitable for protecting a wearer from contact with noxious chemical agents, noxious gases or any other foreign irritants to the human body. Generally, very thin materials are used to fabricate such a liner so as to keep the bulk and stiffness of the liner and the overall glove to a minimum. Rubber and polymer-dipped waterproof liners are not generally acceptable, as they are too stiff, or bulky, or have pinholes and/or thin spots, and as such, adversely affect the dexterity, mobility, and/or durability of the entire glove assembly.

Materials suitable for waterproof liners presently used in glove constructions include relatively inelastic thin, pliable materials such as a breathable microporous expanded polytetrafluoroethylene and other suitable breathable and non-breathable films. Other microporous and non-microporous films having similar characteristics are also suitable for liners, either alone or as a laminated construction bonded to other materials, for example, thin stretch nylon fabric. In assembling these materials into a liner, they are heat sealed, adhesively bonded, glued, or the seams are sealed with waterproof tapes. Stitching is generally avoided, as it produces holes in the material which requires further sealing.

Waterproof/breathable liners can be used either alone with an outer glove shell, or in combination with additional insulation to make an insulated and waterproof glove. In the latter construction, the liner is disposed between the outer shell and the inner insulation liner. In all situations, it is necessary that the liner have sufficient size so as not to adversely affect the dexterity, mobility and tactility of the total glove system. Bending of the wearer's hand within the glove requires that the liner, as well as the other parts of the glove, have sufficient length so as to accommodate the bending of the fingers at the knuckle joints without binding of the layers during such movement of the hand.

Although glove systems incorporating inserts or liners made from a Flat Pattern are less costly to manufacture, (i.e., the liners can be completely manufactured by utilizing an automated seam sealingly process thereby significantly reducing the amount of process steps and labor required to produce the liner) such glove systems are often difficult to don. More particularly, in glove systems incorporating Flat Pattern liners, often the excess liner material gathers in horizontal folds in the palm and dorsal region in a fashion which occludes the passageways which lead to the finger portions of the glove shell. Therefore, when a wearer attempts to don such a glove, his fingers become jammed, or otherwise become entangled within this excess liner material causing great discomfort and frustration to the wearer.

In the past, various attempts have been made to overcome this shortcoming. These attempts have included the application of an adhesive material between the insert, or liner, and the outer glove shell. The adhesive material is applied in a fashion to prevent the excess liner material from occluding the finger passageways. Although this type of solution has achieved varying degrees of success, it suffers from many shortcomings which detract from its usefulness. For example, the process of applying the adhesive material is difficult to control. An excess application of adhesive renders the hand covering too stiff or rigid. An insufficient application of adhesive does not permanently solve the initial problem.

Another disadvantage of a Flat Pattern hand covering made from relatively inelastic materials, is that generally, such a hand covering cannot be used in a stand alone application (e.g., a clean room glove). A Flat Pattern stand alone hand covering is aesthetically unappealing and is functionally ineffective, i.e., the excess material of the palm or dorsal portions can reduce the wearer's gripping ability.

In the electronics and pharmaceutical industries, requirements for contamination control in clean room environments have become more and more demanding. Contamination can result from air-borne particles of submicron size or from material transfer from one surface to another. One source of contamination is from the clean room personnel and their associated clothing. Therefore, on-going efforts exist in developing clothing articles, including gloves, that enhance contamination control. Contamination control is provided by a glove when:

1. The glove prevents particles, or other undesired materials from the hand, to pass from the hand to the outside of the glove;
2. The glove can be rendered free of contamination before used by the wearer; and
3. The glove does not, during use, abrade or otherwise break down, and subsequently become a source of contamination.

Workers in a clean room perform numerous operations while wearing gloves. Throughout the day, they must be able to perform these operations reliably and with minimum hindrance by their gloves. They must be able to handle objects, and move their hands and fingers, both freely and delicately. Therefore, desirable glove characteristics, from the wearer's consideration, are as follows:

1. Form-fitting—A glove should be form-fitting, and contoured to the shape of the hand, neither having an undesirable excess and/or a bunching of the material, nor intense tightening upon the hand.
2. Touch—Touch is defined as the array of sensations arising from the pressure sensitivity of the skin. Therefore, desirably the glove should not impair touch or tactility (i.e. the sense of touch) while picking up and handling objects.
3. Dexterity—Dexterity is the skill in using one's hands. A clean room glove should allow for great dexterity.
4. Comfort—The glove should be comfortable during use, it is undesirable to have either an accumulation of sweat inside the glove or have the hand in intimate contact with something that feels "plastic or rubbery."

Thus, taken collectively, the desired clean room glove:

1. provides contamination control;
2. provides a functional design (i.e. —form-fitting, with good touch and dexterity characteristics); and
3. provides comfort to a wearer.

Flat Pattern hand coverings made from relatively inelastic materials have not heretofore been employed in stand alone applications, such as a clean room glove, due to the limitations of fit which have been described hereinabove. It would be desirable to make such a Flat Pattern hand covering because such a hand covering would be significantly less costly to manufacture than a clean room glove made from other type patterns.

The foregoing illustrates limitations known to exist in present hand coverings. Thus, it is apparent that it would be advantageous to provide an improved hand covering directed to overcoming one or more of the limitations set forth above. Accordingly, a suitable alternative is provided including features more fully disclosed hereinafter.

SUMMARY OF THE INVENTION

The present invention is a distinct advancement in the art of hand coverings, and the techniques for their manufacture. In one embodiment of the present invention, a method for making such a hand covering is provided comprising the following steps:

providing mating first and second Flat Pattern hand covering portions;

bonding said first and second portions to form a complete Flat Pattern hand covering; and permanently defining at least one vertical fold in said hand such that the hand covering conformably fits a suitable human hand after said at least one vertical fold has been permanently defined.

It is, therefore, a purpose of the present invention to provide a method for manufacturing a relatively inelastic insert for a glove system which may be completely and automatically produced in the flat.

It is yet another purpose of the present invention to provide a method for manufacturing a relatively inelastic Flat Pattern hand covering which is functional and comfortable.

It is another purpose of the present invention to provide a method for manufacturing a Flat Pattern hand covering, made from a relatively inelastic material, which may be used in various stand alone applications, such as but not limited to a clean room glove, for example.

The foregoing and other aspects will become apparent from the following detailed description of the invention when considered in conjunction with the accompanying drawing figures.

DETAILED DESCRIPTION OF THE INVENTION

Figure 1:
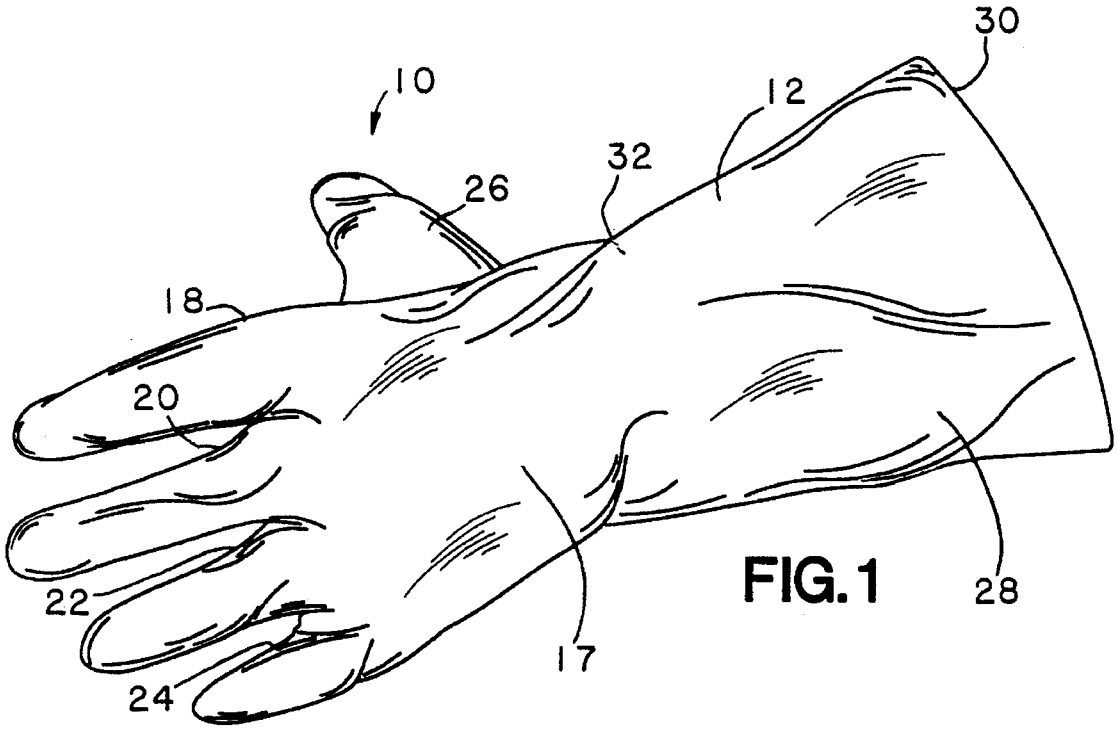
FIG. 1 is a perspective view of a glove system comprising a glove shell and an insert.

Referring now to the drawings, wherein similar reference characters designate corresponding parts throughout the several views, FIG. 1 illustrates generally at 10 a glove system. As used herein, a "glove system" means at least an outer glove shell 12 and an insert or hand covering 14, which is illustrated individually in FIGS. 5A, 5B, 7A, and 7B. The glove system also may optionally include insulation and/or an inner lining, (not shown).

The outer glove shell may be produced from any suitable material, such as but not limited to knit, woven or nonwoven materials, leather, composite fabrics or any other suitable material. The outer glove shell may be patterned in accordance with any suitable pattern, such as but not limited to, the Clute Cut Pattern, Gunn Cut Pattern or the Fourchette Pattern, for example. As best seen by reference to FIGS. 1 and 3, the glove system 10 may include any of the following: a palm portion 16, a dorsal portion 17, finger stalls or passageways 18, 20, 22 and 24, a thumb stall or passageway 26, a gauntlet 28, or an opening 30 facing inwardly of the wearer. Although the glove system 10 is illustrated as a conventional glove system, in the sense that it includes an individual finger stall for each finger of a human hand and a thumb stall, the teachings of the present invention may be applied to other glove systems having less than four finger stalls, but at least one. Additionally, the glove system 10 may be provided with an elastically yielding area (not shown) proximate a wrist portion 32 to provide close contact of the glove system to a wearer's wrist.

Figure 3:
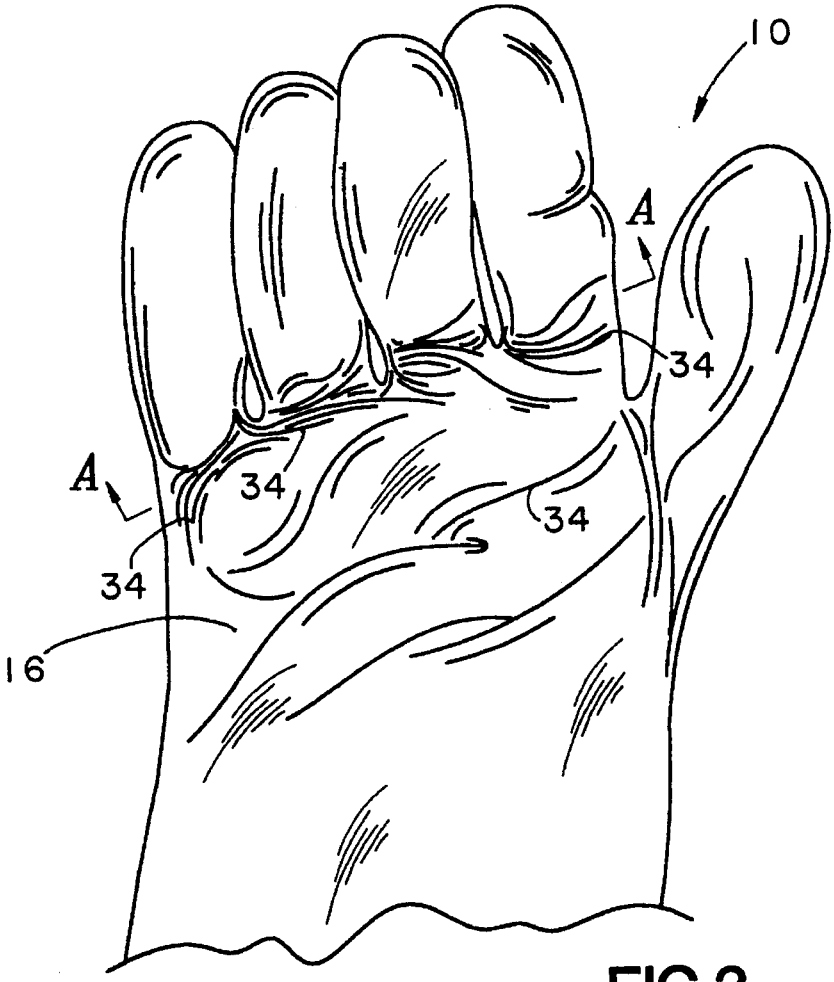
FIG. 3 is a view of the glove system of FIG. 1 in a flexed or slightly curled position.
Figure 3A:
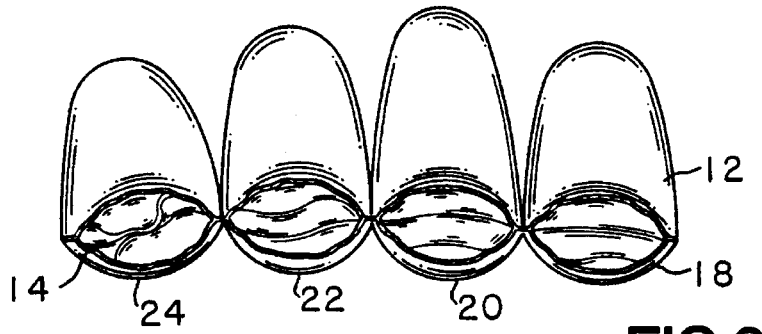
FIG.3A (PRIOR ART)
FIG. 3A is a sectional view of a glove system of FIG. 3, taken along line A—A, and illustrating a glove system with a conventional Flat Pattern insert, which is disposed such that it occludes the finger passageways of the glove shell.

FIG. 3 is a view of a glove system 10 in a flexed or slightly curled position. As seen therein, horizontal folds 34 are formed in the palm region 16. These horizontal folds also form in the dorsal portion 17. In glove systems incorporating conventional Flat Pattern inserts made from relatively inelastic materials, excess insert material gathers in the horizontal folds 34 in a fashion which occludes the finger stalls 18, 20, 22 and 24 of the glove shell 12. This is best seen by reference to FIG. 3A. In the conventional glove system of FIG. 3A, frequently, a wearer's fingers become entangled within the excess material, which makes the donning of such a glove system a frustrating and cumbersome experience.

As should be understood, the insert or hand covering 14 may be made from any material which is desirable for a particular application. Also, the insert or hand covering may be incorporated as an integral element of a glove system 10, or may be employed in a stand alone application. When used as an integral element of a glove system, the insert 14 is conformably dimensioned to be insertably received by a respective glove shell 12.

For purposes of example only, and without intending to limit the scope of the present invention, described hereinafter is a waterproof insert material, a material suitable for a stand alone clean room hand covering, and an insert material suitable for use in glove systems for protecting a wearer from noxious gases.

A material suitable for making a waterproof insert for a glove system may be made of a laminate comprising a membrane of an expanded polytetrafluoroethylene (ePTFE) upon which a 1.8 oz./sq. yd. polyester brush knit is bonded to a first membrane side and a 0.5 oz./sq. yd. nylon nonwoven material is bonded to a second membrane side. The ePTFE membrane is comprised of nodes interconnected by fibrils. Such a membrane may be made in accordance with the teachings of U.S. Pat. No. 4,187,390 or U.S. Pat. No. 3,953,566 which are incorporated herein by reference. In general, the ePTFE membrane will be from about 1 to about 4 mils thick. The polyester brush knit will be next to a wearer's skin in an assembled glove system and the nylon nonwoven material will be applied on an exterior insert surface.

An insert material suitable for use in a glove system for protecting a user from noxious gases is described in detail in U.S. Pat. No. 5,391,426, which is incorporated herein by reference. Briefly, such an insert material may comprise at least the following sequence of layers:

(a) a first pliable porous substrate of porous polytetrafluoroethylene (PTFE) having a thickness of from about 1 to about 2 mils, (b) a gas-blocking water-vapor-permeable polymeric coating (crosslinked polyethyleneimine), and (c) a second pliable porous substrate of porous PTFE having a thickness of from about 1 to about 2 mils.

Such a composite insert material may be combined with backing fabrics and/or facing fabrics. These backing or facing fabrics may be any material, such as woven or nonwoven textiles, or knits. These fabrics can be treated with water and oil repellents or with the gas-blocking polymer, or with both. Fluoroacrylate water repellents are one preferred class of coating on the fabric. Representative fluoroacrylates are available from companies such as E. I. DuPont de Nemours and Co. (Zonyl® compositions) or ICI Co. (Milease® compositions).

A material which may be suitable for use in producing a stand alone clean room glove, made in accordance with the teachings of the present invention, comprises at least:

(a) a microporous polymeric membrane having a thickness of less than about 4 mils, (b) a water vapor-permeable polymer, and (c) an elastomeric thermoplastic fibrous nonwoven web in which the fibers are elastomeric and are less than 50 microns in diameter.

Such a material is described in detail in U.S. Pat. No. 5,036,551, which is incorporated herein by reference.

Figure 2:
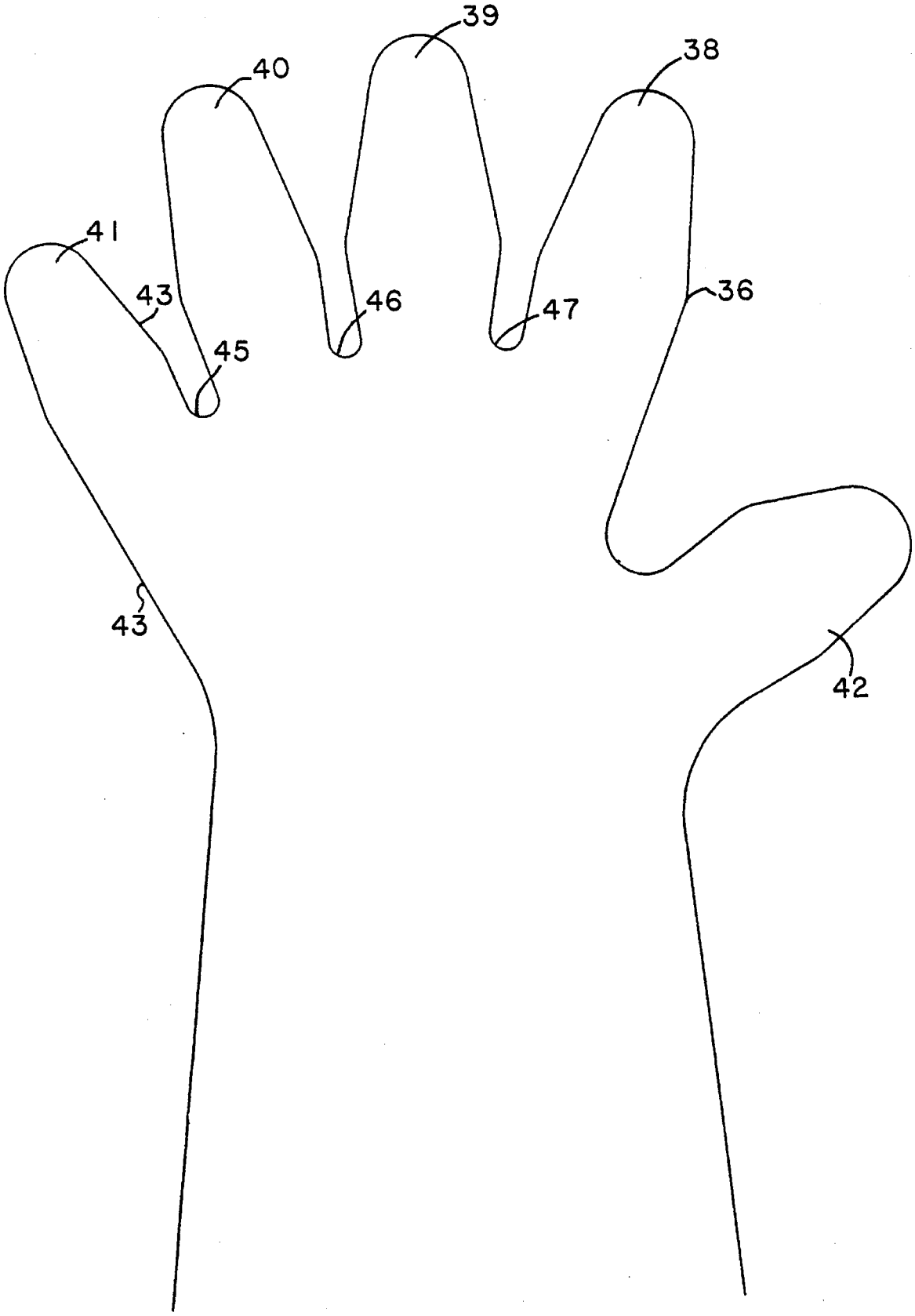
FIG. 2 is a plan view of a Flat Pattern used to make a hand covering in accordance with the teachings herein.

FIG. 2 is a pattern 36 for sizing blanks to be assembled into a hand covering in accordance with the teachings herein. Pattern 36 is a Flat Pattern type. Pattern 36 defines half-finger portions 38, 39, 40 and 41, and a half thumb portion 42. The half-finger portions and the half thumb portion define a sufficient length to enclose the finger it is designed to fit. The half finger portions are generally symmetrical. A peripheral edge 43 forms three V-shaped finger crotches 45, 46 and 47.

An insert 14 for the glove system 10 is made by initially cutting two pattern pieces, or blanks, from the pattern 36. The blanks are positioned in a flat superimposed relationship, one to each other, and are joined or seamed along the peripheral edge 43. The blanks may be seamed by any suitable method, such as by adhesive bonding, welding, heat sealing, ultrasonic sealing, or RF sealing, for example. After the blanks have been seamed to form a flat pattern insert 14, at least one vertical fold is defined in the insert 14 such that the at least one vertical fold is oriented substantially parallel to at least one finger stall of the insert. Preferably, a plurality of vertical folds are formed in the insert. The vertical folds may be formed by any suitable method. One such method may include "pinching" the insert material at predetermined locations. This method is time consuming.

Figure 4:
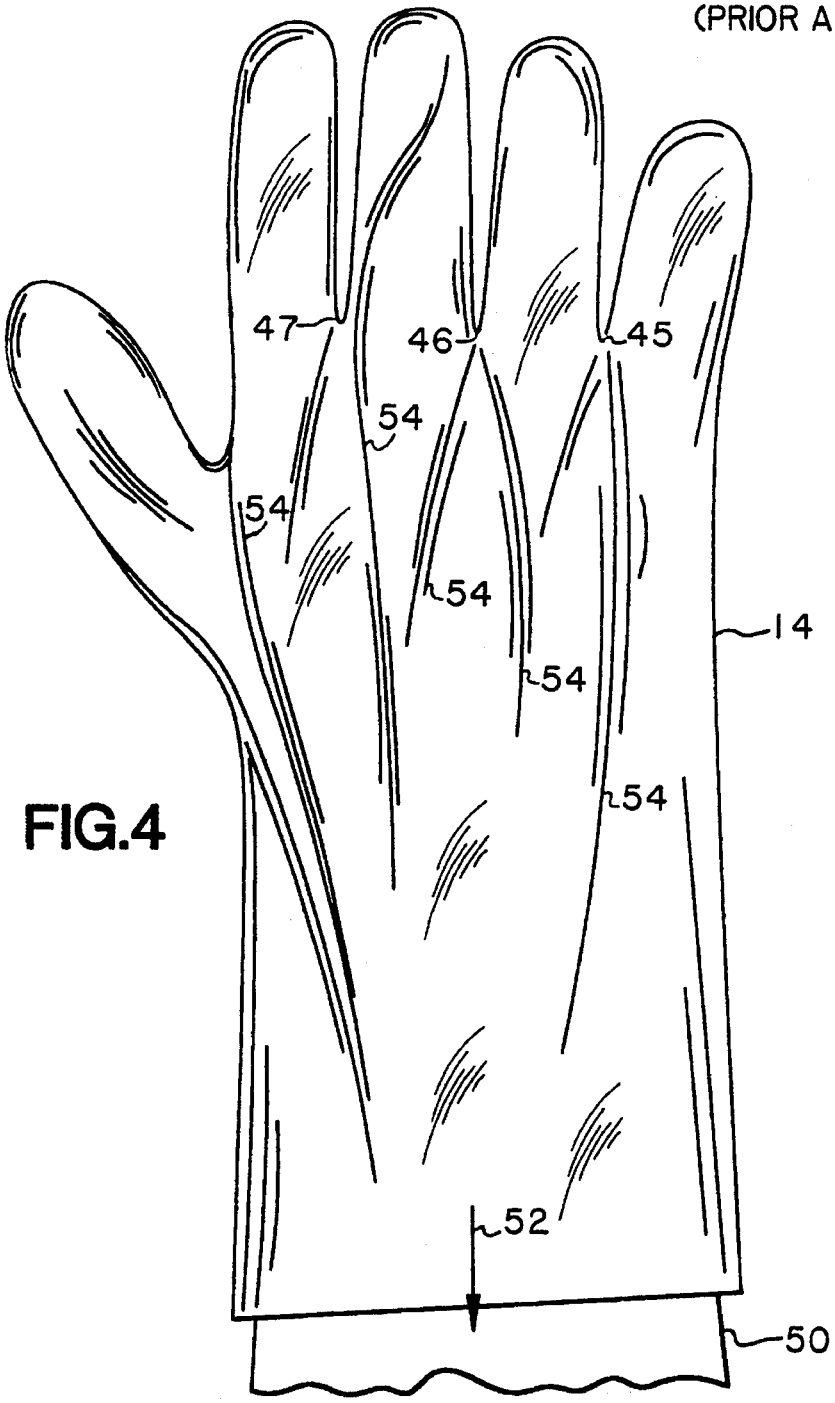
FIG. 4 is a plan view of a Flat Pattern hand covering having disposed within its interior an orienting assembly. An arrow represents a force applied to the hand covering against the orienting assembly. This force creates at least one vertical fold oriented substantially parallel to at least one finger portion of the hand covering.

Another method of forming vertical folds includes pulling an insert or hand covering 14 against a suitable apparatus. Preferably, an orienting assembly 50 may be employed to establish at least one vertical fold in the insert or hand covering. Referring to FIG. 4, the orienting assembly 50 may comprise a flat main body formed of a resilient material which may define a thumb portion and at least one finger portion. The orienting assembly is dimensioned to be insertably received by the insert or hand covering 14. In a preferred embodiment, the orienting assembly defines a thumb portion and four finger portions. The thumb and finger portions are each formed to be insertably received by the thumb stall 26 and a respective finger stall 18, 20, 22 and 24. The orienting assembly is shaped such that it may be compressed or squeezed upon insertion into the insert or hand covering 14. Upon insertion, the resilient orienting assembly is permitted to decompress, and at such time, the orienting assembly fills the interior of the insert 14, in much the same manner as a human hand. When properly inserted, the orienting assembly extends from the finger stalls, through the palm portion 16 and out the opening 30. Thereafter, the insert 14 is pulled against the orienting assembly 50 in a direction generally indicated by the arrow 52. This force creates at least one vertical fold 54. Typically, this force creates a plurality of vertical folds, which each serves to gather excess insert material in the palm portion 16 and the dorsal portion 17. Generally, these vertical folds originate from the finger crotches 45, 46, and 47 and extend through a predetermined length of the insert. The vertical folds 54 generally are oriented parallel to the finger stalls 18, 20, 22 and 24.

After at least one vertical fold has been formed in the insert or hand covering, a means is employed to permanently define the at least one vertical fold. For the purpose of example only, the at least one vertical fold, or the plurality of vertical folds, may be permanently defined by any suitable method, such as by adhesive bonding, welding, heat sealing, ultrasonic sealing, or RF sealing. Alternatively, a length of tape may be employed individually, or in combination with any of the foregoing. As used herein, the term "tape" means a narrow strip of a kit, woven, nonwoven or polymeric material, with or without a bonding substance disposed thereupon. A suitable permanent vertical fold defining means is applied to the insert or hand covering 14 at predetermined locations. Preferably, the permanent vertical defining means is applied to the insert at either the palm portion or the dorsal portion. Most preferably, the means 56 for permanently defining the vertical folds 54 is applied to both the palm portion 16 and the dorsal portion 17.

As should be understood, in a case where a vertical fold defining means is to be applied to both the palm and the dorsal portion of an insert, any combination of the foregoing may be employed. For example, adhesive a bonding may be employed to permanently define vertical folds in the palm portion, and a length of tape may be employed to permanently define folds in the dorsal portion. After a desired permanent vertical fold defining means has been applied to the insert, the excess insert material, which previously existed in the palm and dorsal portions, is permanently gathered, such that the insert conformably fits a suitable human hand, unlike a conventional Flat Pattern insert made from relatively inelastic material.

Figure 6:
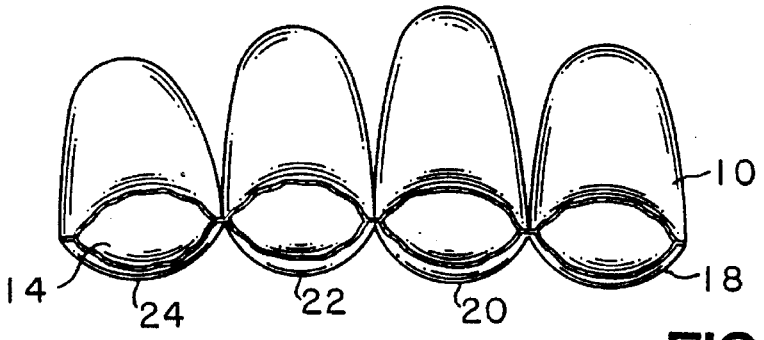
FIG. 6 is a sectional view of a glove system of FIG. 3, taken along line A—A, and illustrating a glove system with a Flat Pattern insert of the present invention, which does not occlude the finger passageways of the glove shell.
Figure 7A:
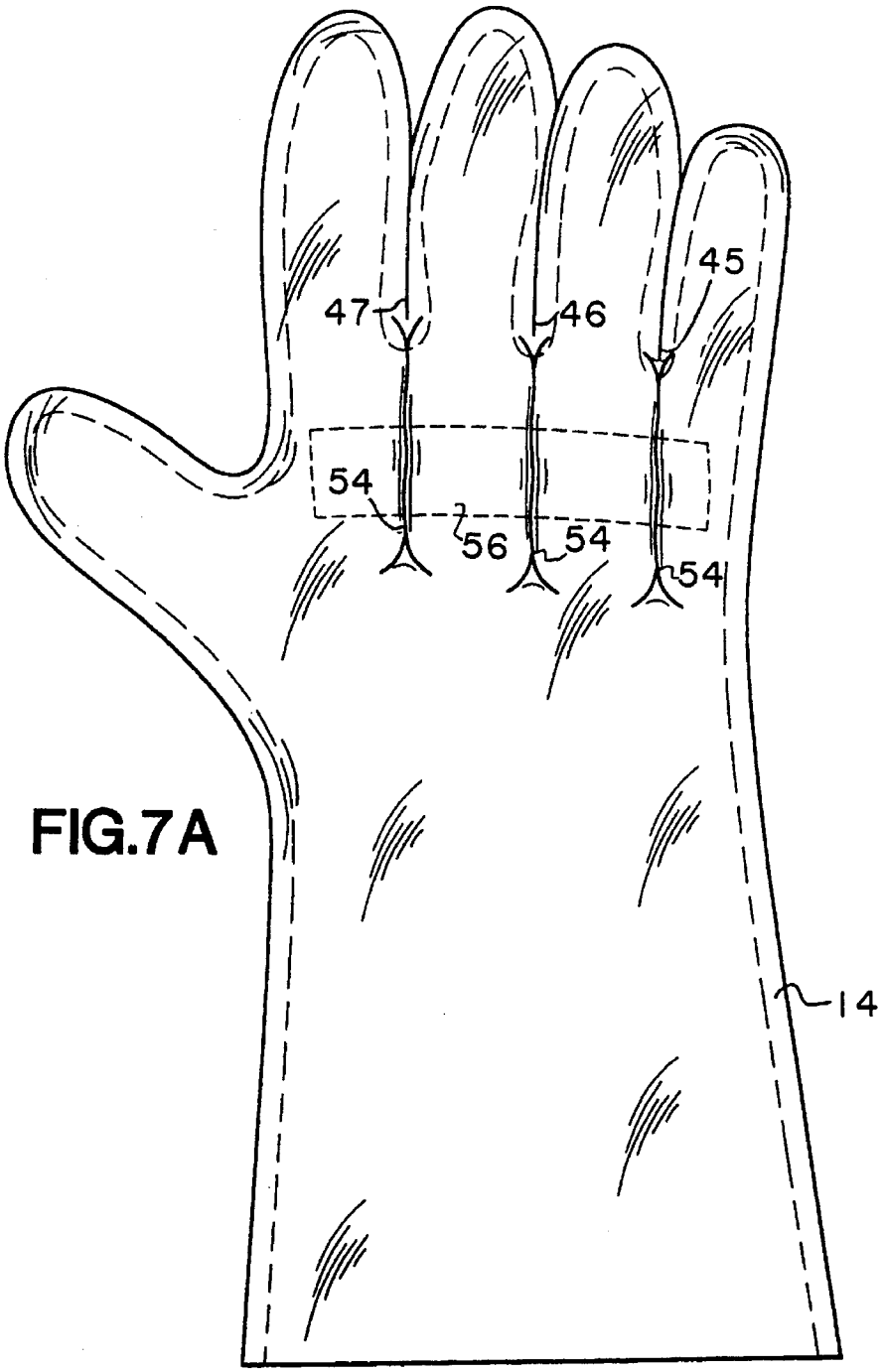
FIG. 7A is a plan view (palm side up) of an alternate embodiment of the hand covering of the present invention.
Figure 7B:
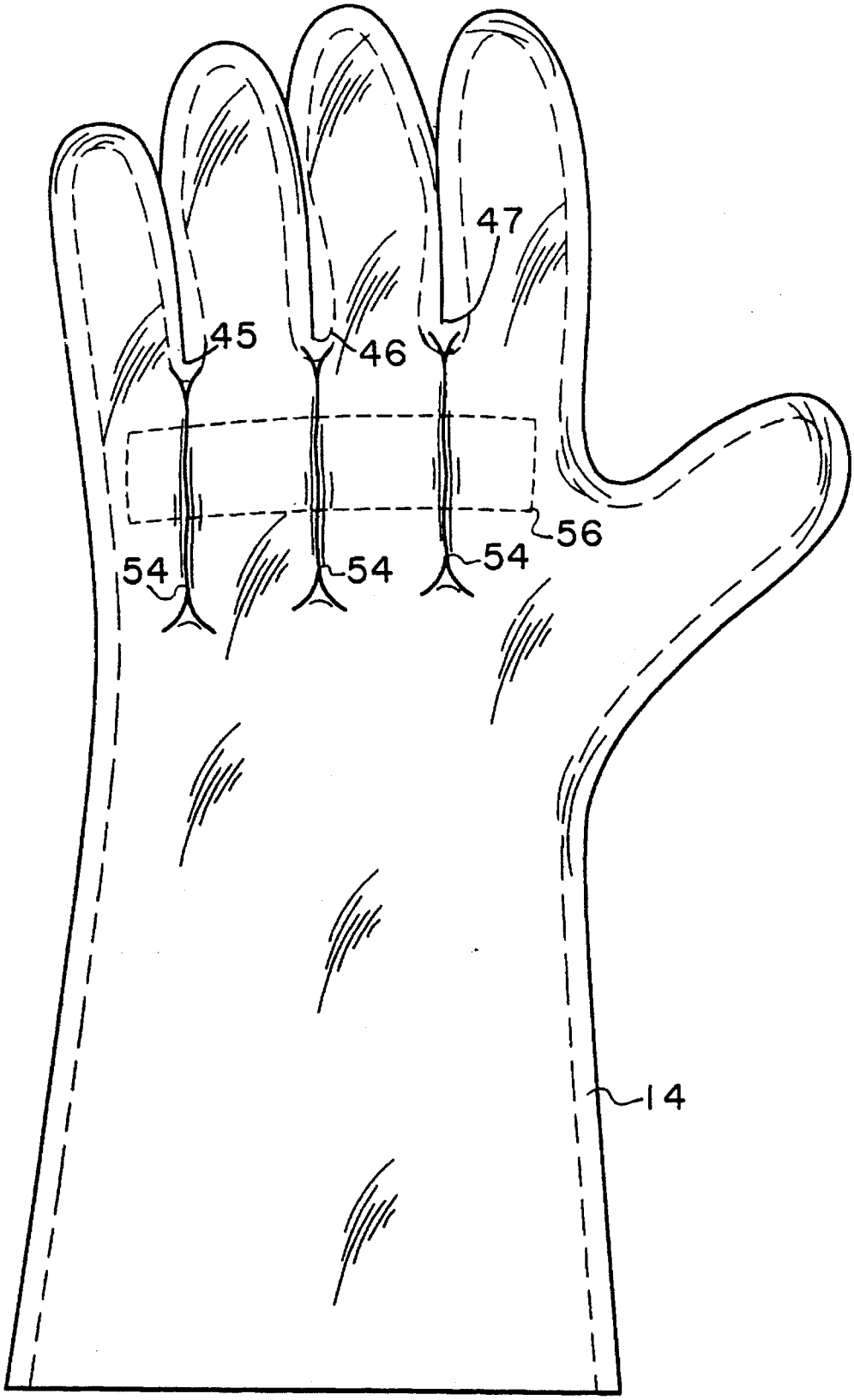
FIG. 7B is a plan view (dorsal side up) of the hand covering of FIG. 7A.

As should be understood, if the insert of the present invention is used as an element of a glove system 10, the insert will not occlude the finger stalls 18, 20, 22 and 24, as best seen by reference to FIG. 6.

In a preferred embodiment of the present invention, the permanent vertical fold defining means is a strip of tape having disposed thereupon a suitable permanent bonding material. Such a strip of tape may include, but is not limited to, heat sealable tapes, heat sealable urethane tapes, heat sealable PVC tapes, or pressure sensitive tapes. The strip of tape may be from about ¼" to about 1 ½" wide. As best seen by reference to FIGS. 5A, 5B, 7A and 7B, the strip of tape may extend across the palm and dorsal portions, short of the peripheral edge 43. Typically, a length of about 4 ½" is a suitable length to perform in accordance with the teachings herein, although the actual length will depend upon the relative size of the insert or hand covering 14. Also, preferably, the strip of tape is positioned in the palm and dorsal portions at a location slightly below the finger crotches 45, 46 and 47.

Figure 5A:
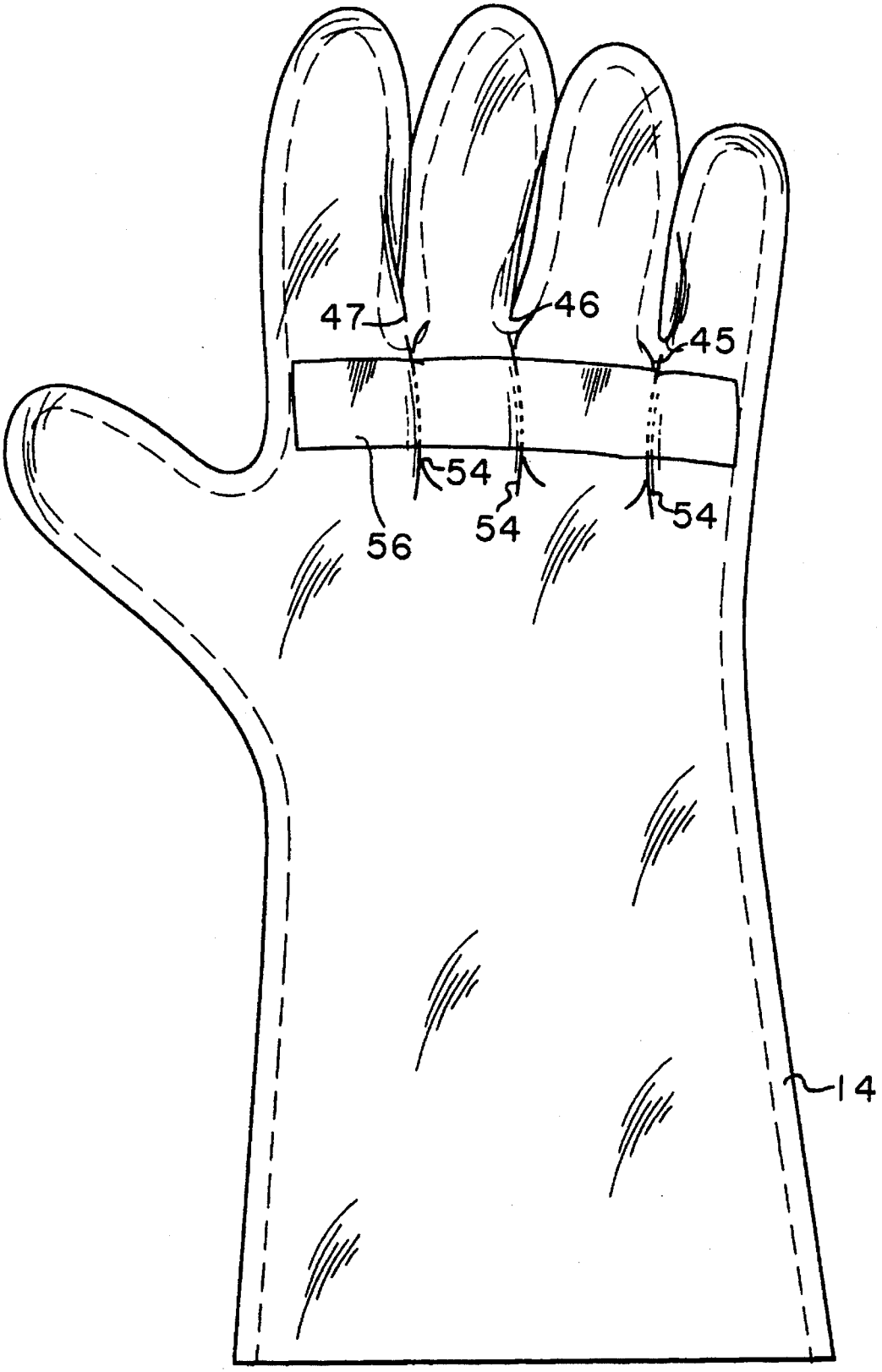
FIG. 5A is a plan view (palm side up) of a hand covering made in accordance with the present invention.
Figure 5B:
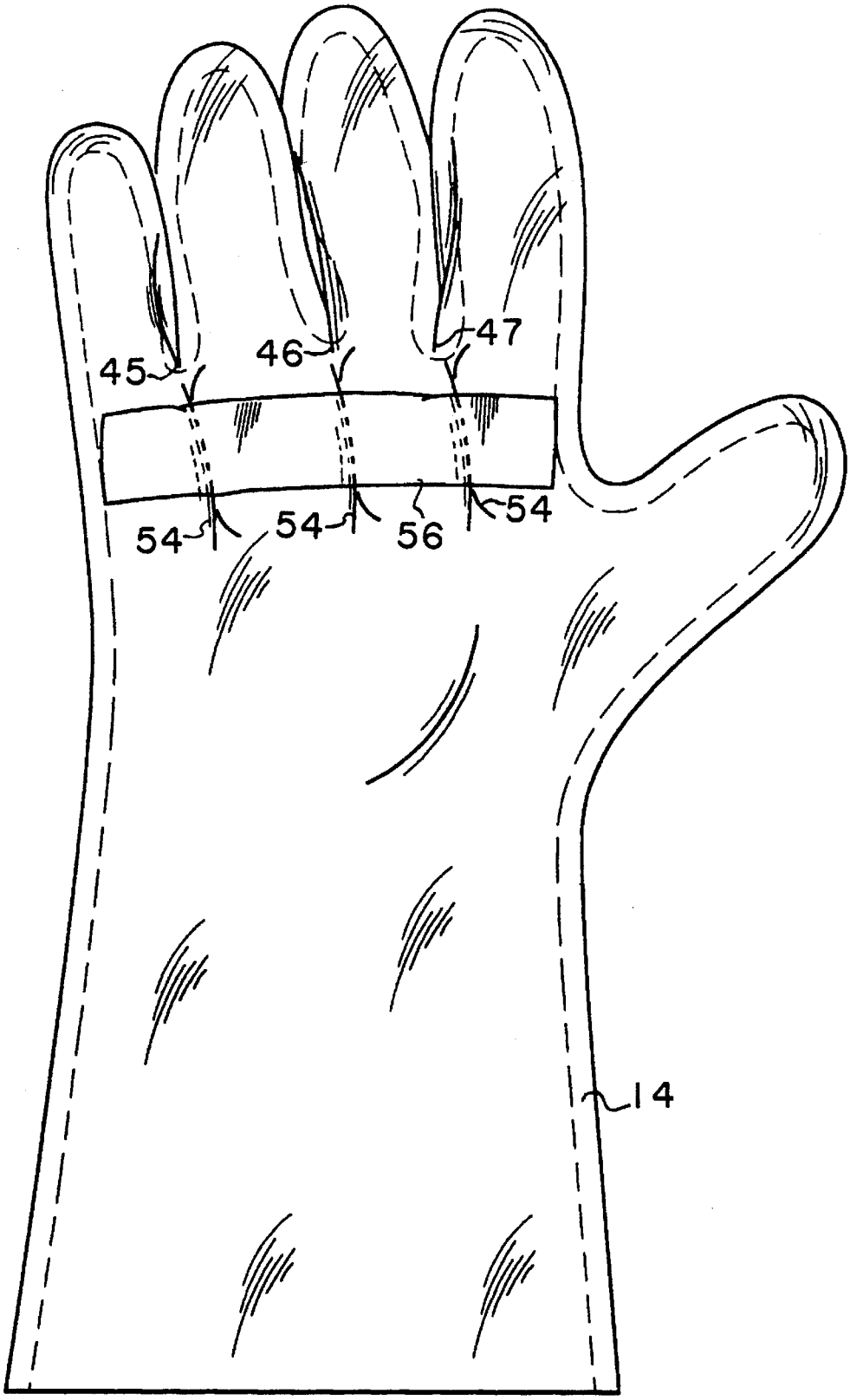
FIG. 5B is a plan view (dorsal side up) of the hand covering of FIG. 5A.

If the insert 14 is to be used within a glove system 10, the tape 56 may be applied to an exterior insert surface, as best seen by reference to FIGS. 5A and 5B. Alternatively, if the insert is to be used as a hand covering for a stand alone application, the tape is first applied as described hereinabove, and then the insert 14 is reversed, i.e., the insert is pulled inside out such that the tape is disposed interiorly of the insert, as best seen by reference to FIGS. 7A and 7B.

In a most preferred embodiment of the present invention, the permanent vertical fold defining means is a two layer heat sealable urethane tape, which is commercially available from W. L. Gore & Associates, Inc. under the tradename GORE-SEAM™. Such a tape is comprised of a layer of expanded polytetrafluoroethylene bonded to a layer of hot-melt urethane adhesive.

Without intending to limit the scope of the present invention, the present invention may be better understood by referring to the following examples:

EXAMPLE 1

A breathable waterproof insert material was provided which was defined by a laminate which included a membrane of ePTFE having opposed first and second sides. A 1.8 oz./sq. yd. polyester brush knit was bonded to a first membrane side, and a 0.5 oz./sq. yd. nylon nonwoven material was bonded to a second membrane side. A hand covering was made by cutting suitable blanks and seaming the blanks by adhesively bonding the blanks as described hereinabove. The orienting assembly was then inserted into the hand covering and a plurality of vertical folds were established by pulling the hand covering against orienting assembly. A strip of GORE-SEAM™tape ⅞" wide by 4½" in length was placed perpendicularly across the vertical folds at a location slightly below the finger crotches on both the palm and dorsal portions of the insert. The hand covering and tapes were then placed under a heated press at a temperature of between 250° F. to about 350° F. A pressing force of about 2 pounds per square inch was applied to the hand covering and tape for a dwell time of from about 2 to about 4 seconds. Thereafter, the hand covering was removed from the press. The resultant hand covering had a palm circumference which was sized relative to a palm circumference of a human hand.

EXAMPLE 2

An insert material was provided which was defined by a laminate which included:

(a) a first pliable substrate of porous polytetrafluoroethylene PTFE, (b) a gas-blocking water-vapor-permeable polymeric coating (crosslinked polyethyleneimine), and (c) a second pliable substrate of porous PTFE.

The thickness of this laminate was less than about 4 mils. Bonded to a first laminate side was a 1.8 oz./sq. yd. Nomex® jersey knit. Bonded to a second laminate side was a 0.5 oz./sq. yd. nylon nonwoven material. A hand covering was made by cutting suitable blanks and seaming the blanks by adhesively bonding the blanks as described hereinabove. The orienting assembly was then inserted into the hand covering and a plurality of vertical folds were established by pulling the hand covering against orienting assembly. A strip of GORE-SEAM™ tape ⅞" wide by 4½" in length was placed perpendicularly across the vertical folds at a location slightly below the finger crotches on both the palm and dorsal portions of the insert. The hand covering and tapes were then placed under a heated press at a temperature of between 250° F. to about 350° F. A pressing force of about 2 pounds per square inch was applied to the hand covering and tape for a dwell time of from about 2 to about 4 seconds. Thereafter, the hand covering was removed from the press. The resultant hand covering had a palm circumference which was sized relative to a palm circumference of a human hand.

Resultant hand coverings made in accordance with the teachings herein may have a palm circumference which has been reduced anywhere from 10% to 50% the original dimensions of the palm circumference.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. A method of producing a hand covering, the hand covering having a plurality of finger stalls, a thumb stall, a thumb crotch, a palm portion, a dorsal portion, and a plurality of finger crotches, the method comprising the following steps:

providing mating first and second Flat Pattern hand covering portions;

seaming said first and second hand covering portions to form a complete Flat Pattern hand covering;

providing an orienting assembly dimensioned to be insertably received within said complete hand covering;

providing a sufficient orienting force, against the orienting assembly, to form vertical folds in the hand covering;

providing at least one length of tape;

permanently bonding the at least one length of tape in a location on the hand covering generally laterally aligned with the thumb crotch; and permanently defining the vertical folds in said hand covering with the at least one length of tape such that an original palm circumferential dimension of the hand covering is reduced in an amount from about 10% to about 50%.

2. A method of producing a hand covering, the hand covering having at least one finger stall, a thumb stall, a palm portion, a dorsal portion, and at least one finger crotch, the method comprising the following steps:

providing mating first and second Flat Pattern hand covering portions;

seaming said first and second portions to form a complete Flat Pattern hand covering;

providing an orienting assembly dimensioned to be insertably received by said complete hand covering;

providing a sufficient orienting force, against the orienting assembly, to form at least one vertical fold in the hand covering;

providing at least one length of heat sealable tape;

positioning the length of tape across the at least one vertical fold;

applying a predetermined amount of heat and pressure to the length of tape; and permanently defining the vertical folds in said hand covering with the at least one length of tape such that the hand covering conformably fits a suitable human hand.

3. The method of claim 1 including applying heat of from about 250° F. to about 350° F. to the length of tape.

4. The method of claim 1 including applying pressure of about 2 pounds per square inch to the tape.

* * * * *